US008913903B2

(12) United States Patent
Hamaya

(10) Patent No.: US 8,913,903 B2
(45) Date of Patent: Dec. 16, 2014

(54) IMAGE FORMING APPARATUS CAPABLE OF ELECTRICALLY DETECTING USAGE STATE OF PROCESS CARTRIDGE MOUNTED THEREIN

(71) Applicant: Masahito Hamaya, Nagoya (JP)

(72) Inventor: Masahito Hamaya, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 51 days.

(21) Appl. No.: 13/720,222

(22) Filed: Dec. 19, 2012

(65) Prior Publication Data

US 2013/0177326 A1 Jul. 11, 2013

(30) Foreign Application Priority Data

Jan. 5, 2012 (JP) ..... 2012-000585

(51) Int. Cl.
*G03G 15/00* (2006.01)
*G03G 21/18* (2006.01)

(52) U.S. Cl.
CPC ..... *G03G 21/1867* (2013.01); *G03G 21/1875* (2013.01)
USPC ..... 399/12; 399/88; 399/111

(58) Field of Classification Search
USPC ..... 399/12, 13, 88, 111, 119, 262
See application file for complete search history.

(56) References Cited

U.S. PATENT DOCUMENTS 5,053,816 A * 10/1991 Takahashi ..... 399/12
7,095,967 B2 8/2006 Karakama et al.
7,512,347 B2 3/2009 Suzuki et al.
7,978,997 B2 7/2011 Tokuda
2002/0012542 A1 1/2002 Karakama et al.
2005/0025508 A1 2/2005 Karakama et al.
2005/0276617 A1 12/2005 Matsumoto et al.
2006/0193646 A1 8/2006 Suzuki et al.
2007/0059018 A1 3/2007 Tokuda
2012/0051762 A1 3/2012 Maruyama et al.
2013/0051816 A1* 2/2013 Itabashi ..... 399/12
2013/0084081 A1 4/2013 Itabashi et al.

FOREIGN PATENT DOCUMENTS

EP 1016939 A2 7/2000
JP 07-160173 A 6/1995
JP 09-171340 A 6/1997
JP 09-190136 A 7/1997

(Continued)

OTHER PUBLICATIONS

European Search Report issued in European Patent Application No. 12186014.2 mailed on Jan. 2, 2014. [corrected citation].

(Continued)

*Primary Examiner* — Sophia S Chen
(74) *Attorney, Agent, or Firm* — Banner & Witcoff, Ltd.

(57) ABSTRACT

An image forming apparatus includes: a process cartridge; a voltage applying unit; a contact; an electric line; a detection unit; and a control unit. The voltage applying unit generates a voltage and applies the voltage to the process cartridge. The contact is switched between an ON state and an OFF state based on a usage state of the process cartridge. The electric line electrically connects the voltage applying unit to the process cartridge. The detection unit is electrically connected to the electric line via the contact and provides either one of a first detection output corresponding to the ON state and a second detection output corresponding to the OFF state. The control unit executes a determination process in a determination mode for determining the usage state of the process cartridge based on either one of the first detection output and the second detection output of the detection unit.

8 Claims, 11 Drawing Sheets

(56) References Cited

FOREIGN PATENT DOCUMENTS

| | | | |
|---|---|---|---|
| JP | 10-003241 | A | 1/1998 |
| JP | 11-258968 | A | 9/1999 |
| JP | 3416664 | B2 | 6/2003 |
| JP | 2006-267994 | A | 10/2006 |
| JP | 2006-337401 | A | 12/2006 |
| JP | 2007-079284 | A | 3/2007 |
| JP | 3938545 | B2 | 6/2007 |
| JP | 2009-175293 | A | 8/2009 |
| JP | 2012-053168 | A | 3/2012 |
| JP | 2013-073213 | A | 4/2013 |

OTHER PUBLICATIONS

European Search Report issued in European Patent Application No. 121860142.2 mailed on Jan. 2, 2014.

Non-Final Office Action received in corresponding U.S. Appl. No. 13/628,091 mailed Apr. 17, 2014.

* cited by examiner

IMAGE FORMING APPARATUS CAPABLE OF ELECTRICALLY DETECTING USAGE STATE OF PROCESS CARTRIDGE MOUNTED THEREIN

CROSS REFERENCE TO RELATED APPLICATION

This application claims priority from Japanese Patent Application No. 2012-000585 filed Jan. 5, 2012. The entire content of the priority application is incorporated herein by reference.

TECHNICAL FIELD

The present invention relates to an image forming apparatus.

BACKGROUND

A conventional technology disclosed for an image forming apparatus involves performing a new-product detection operation when a process apparatus is mounted in a main casing of the image forming apparatus to determine whether the process apparatus is new. A photo-interrupter provided in the main casing detects a movable member that moves downward only when the process apparatus is new.

SUMMARY

However, since the conventional image forming apparatus described above requires the photo-interrupter to detect the movable member, the conventional apparatus leads to an increase in required parts and a tendency to increase the size of the image forming apparatus.

In view of the foregoing, it is an object of the present invention to perfect the above technology by eliminating the photo-interrupter.

In order to attain the above and other objects, the present invention provides an image forming apparatus including: a main casing; a process cartridge; a voltage applying unit; a contact; an electric line; a detection unit; and a control unit. The process cartridge is configured to be mounted in and removed from the main casing. The voltage applying unit is configured to generate a voltage and to apply the voltage to the mounted process cartridge. The contact is configured to be switched between an ON state and an OFF state based on a usage state of the mounted process cartridge. The electric line is configured to electrically connect the voltage applying unit to the mounted process cartridge. The detection unit is configured to be electrically connected to the electric line via the contact and to provide either one of a first detection output corresponding to the ON state of the contact and a second detection output corresponding to the OFF state of the contact. The control unit is configured to execute a determination process in a determination mode for determining the usage state of the mounted process cartridge based on either one of the first detection output and the second detection output of the detection unit.

The term "determining the usage state" used herein indicates determination on whether the mounted process cartridge is new or used, whether the mounted process cartridge is suitable or unsuitable for the image forming apparatus, and whether the color of the mounted process cartridge is correct or not.

BRIEF DESCRIPTION OF THE DRAWINGS

In the drawings;

FIGS. 6A through 6C are explanatory diagrams showing the ON/OFF configuration of a contact in which a switching gear and the contact are shown as viewed from a rear side of the laser printer; and in which FIG. 6A shows a relationship between the switching gear and the contact when the switching gear is at an initial position; FIG. 6B shows a relationship between the switching gear and the contact when the switching gear is at a detecting position; and FIG. 6C shows a relationship between the switching gear and the contact when the switching gear is at a halted position;

FIGS. 7A through 7C are explanatory diagrams showing the ON/OFF configuration of the contact in which the switching gear and the contact are shown as viewed from a left side of the laser printer; and in which FIG. 7A shows a relationship between the switching gear and the contact when the switching gear is at the initial position; FIG. 7B shows a relationship between the switching gear and the contact when the switching gear is at the detecting position; and FIG. 7C shows a relationship between the switching gear and the contact when the switching gear is at the halted position;

FIGS. 11A through 11C are explanatory diagrams showing an ON/OFF configuration of the contact in which a switching gear according to one variation of the embodiment and the contact are shown as viewed from a left side of the laser printer; and in which FIG. 11A shows a relationship between the switching gear and the contact when the switching gear is at the initial position; FIG. 11B shows a relationship between the switching gear and the contact when the switching gear is at the detecting position; and FIG. 11C shows a relationship between the switching gear and the contact when the switching gear is at the halted position.

DETAILED DESCRIPTION

A laser printer as an image forming apparatus according to one embodiment of the present invention will be described with reference to FIGS. 1 through 10. Throughout the specification, the terms "upward", "downward", "upper", "lower", "above", "below", "beneath", "right", "left", "front", "rear" and the like will be used assuming that the image forming apparatus is disposed in an orientation in which it is intended to be used. More specifically, a side of the printer 1 at which a cover 7 is provided and a corresponding side of a process cartridge 18 mounted in the printer 1 will be referred to as "front side," while an opposite side will be referred to as "rear side." Further, a near side of the printer 1 and the process cartridge 18 in FIG. 2 will be referred to as "left side," while a far side will be referred to as "right side."

1. Overall Structure of Laser Printer

Figure 1:
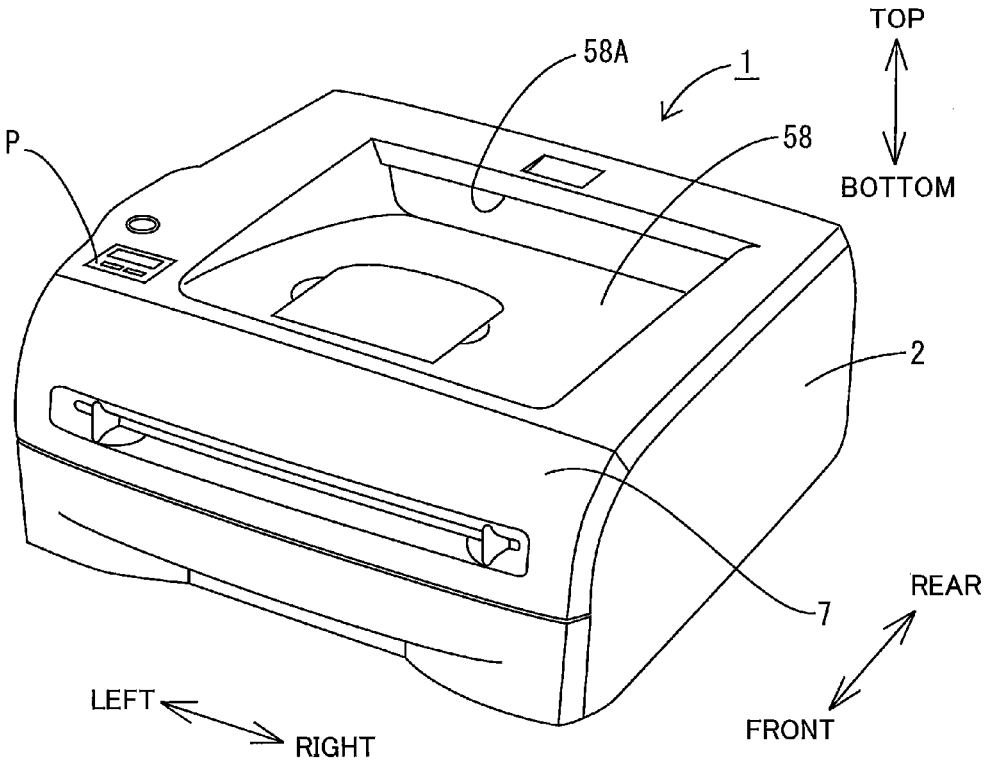
FIG. 1 is a perspective view of a laser printer according to one embodiment of the present invention.

Referring to FIG. 1, the printer 1 has a box-like main casing 2 that functions as an overall outer cover. The main casing 2 has a top surface serving as a discharge tray 58. More specifically, a discharge opening 58A is formed in an inner wall of the main casing 2 defining the discharge tray 58. After undergoing an image forming operation in the printer 1, sheets 3 are discharged through the discharge opening 58A in a forward direction and are received by the discharge tray 58. An operating panel P is provided in a top wall of the main casing 2 at a position to a side of a front edge of the discharge tray 58. The cover 7 is provided on a front portion of the main casing 2.

Figure 2:
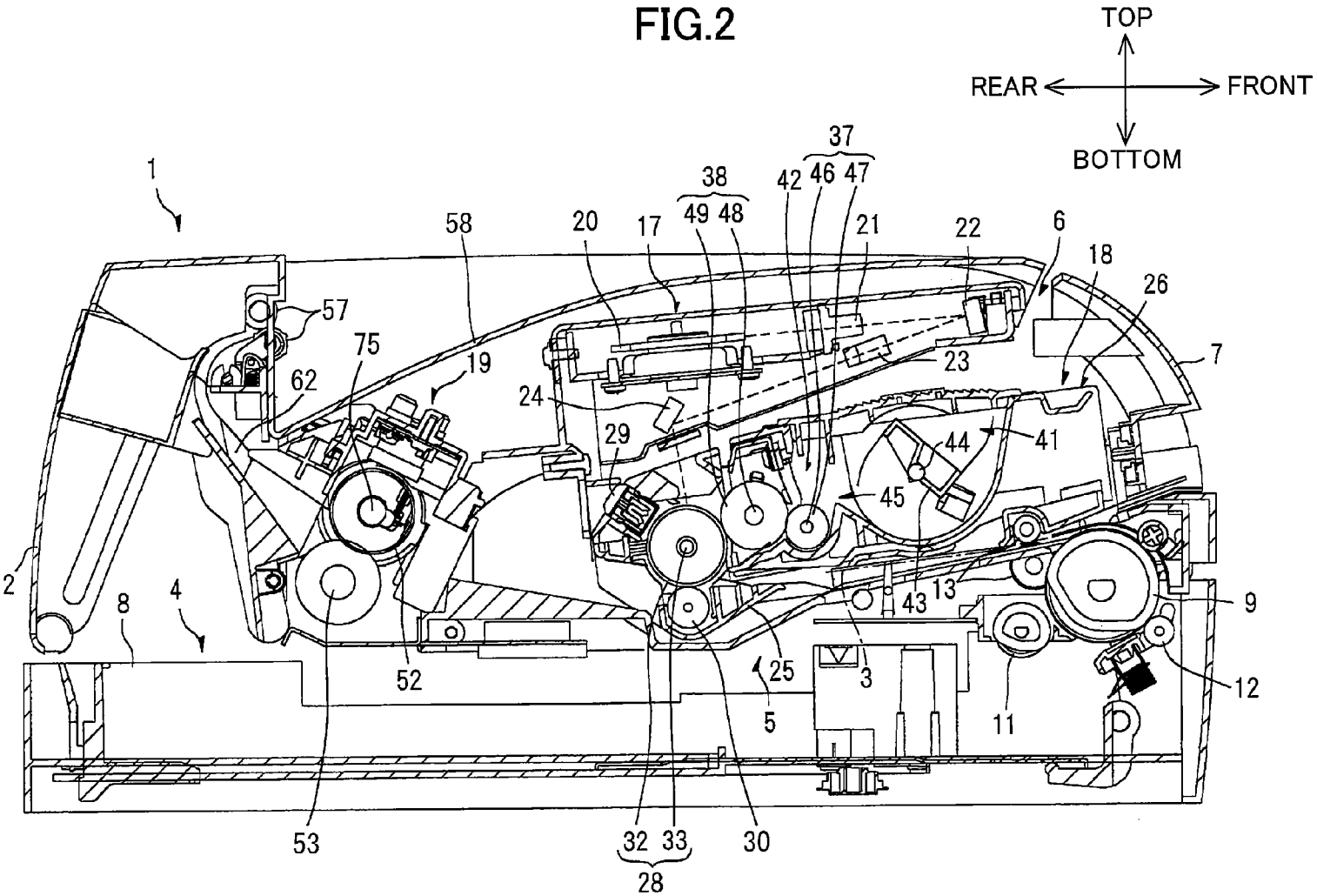
FIG. 2 is a cross-sectional view showing essential parts of the laser printer when a process cartridge is mounted therein.
Figure 3:
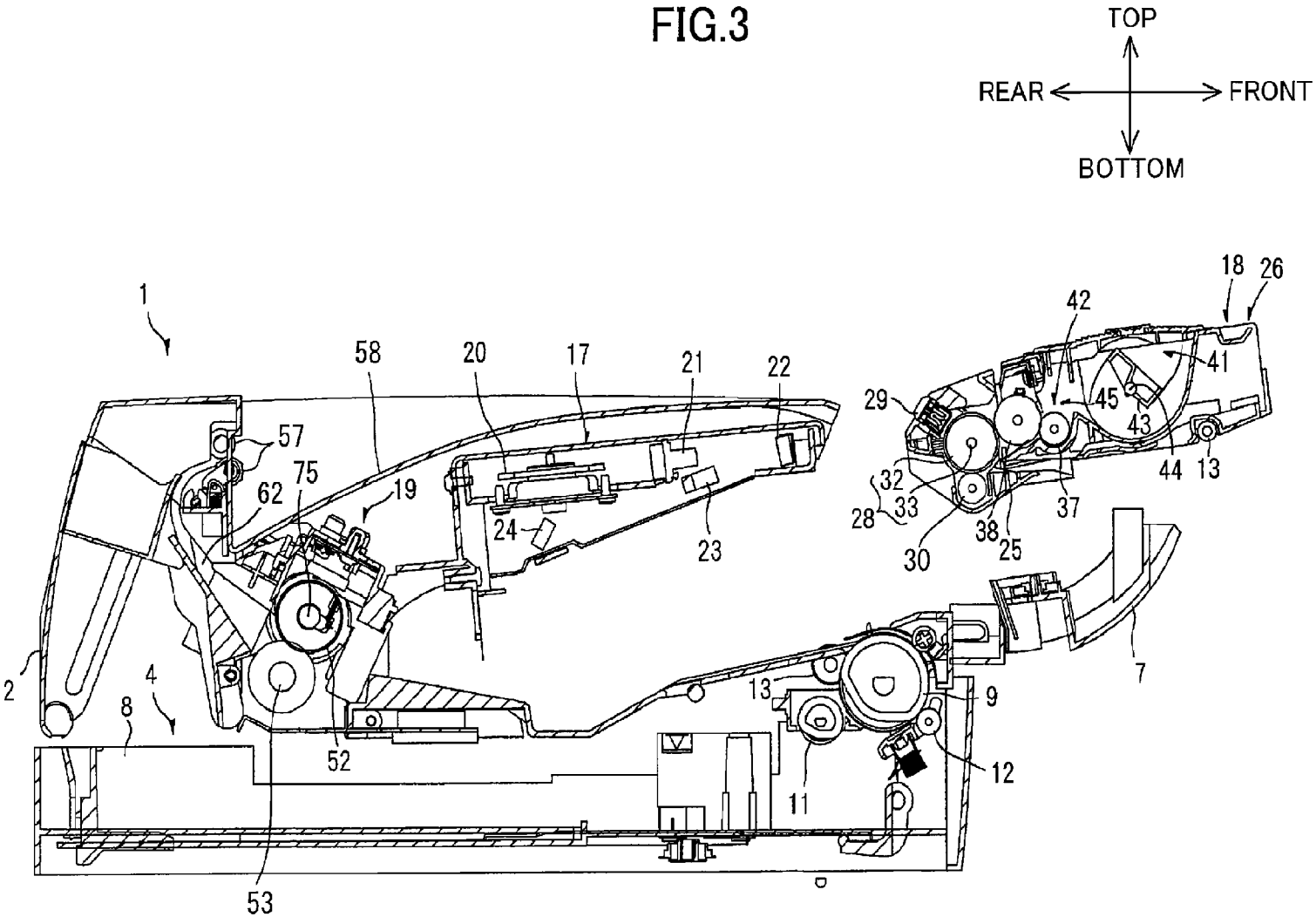
FIG. 3 is a cross-sectional view showing essential parts of the laser printer when the process cartridge has been removed therefrom.
Figure 4:
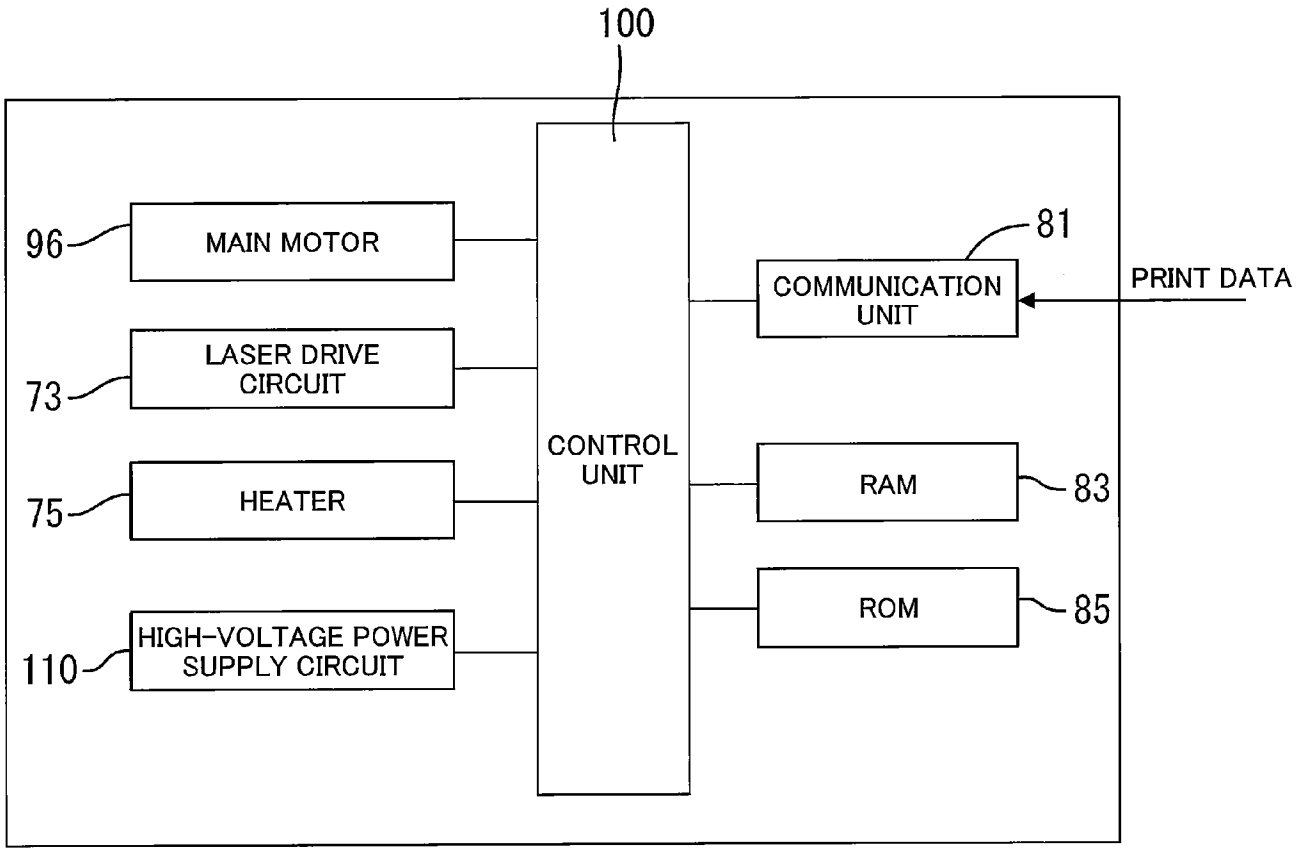
FIG. 4 is a block diagram showing a general electrical structure of the laser printer.

Next, an internal structure of the printer 1 will be described while referring to FIG. 2. As shown in FIG. 2, the printer 1 includes a sheet feeding unit 4 for supplying the sheets 3 to be printed, and an image forming unit 5 for forming images on the sheets 3 supplied by the sheet-feeding unit 4, both of which are disposed inside the main casing 2.

An access opening 6 is formed in a front wall of the main casing 2 to allow mounting and removal of the process cartridge 18 described later. The cover 7 can be opened and closed on the main casing 2 for exposing and covering the access opening 6.

More specifically, the cover 7 is pivotably supported on a cover shaft (not shown) inserted through its bottom edge. When the cover 7 is open, the process cartridge 18 can be mounted in or removed from the main casing 2 through the access opening 6.

The sheet feeding unit 4 is primarily configured of a paper tray 8 disposed in a bottom section of the main casing 2, and various rollers disposed at a front end portion of the paper tray 8. The rollers include a pickup roller 11, a feeding roller 9, a pinch roller 12, and registration rollers 13.

The image forming unit 5 includes a scanning unit 17, the process cartridge 18, and a fixing unit 19. The scanning unit 17 is disposed at a top section of the main casing 2 and includes a laser light source (not shown), a polygon mirror 20 that is driven to rotate, an fθ lens 21, a reflecting mirror 22, a lens 23, and a reflecting mirror 24. The laser light source is adapted to emit a laser beam based on image data. As indicated by a dashed line in FIG. 2, the laser beam is deflected by the polygon mirror 20 so as to pass through the fθ lens 21, is reflected back by the reflecting mirror 22 so as to pass through the lens 23, and is reflected downward by the reflecting mirror 24 so as to be irradiated in a high-speed scan over the surface of a photosensitive drum 28 (described later) provided in the process cartridge 18.

The process cartridge 18 is detachably mounted in the main casing 2 beneath the scanning unit 17. The process cartridge 18 includes a drum cartridge 25, and a developer cartridge 26 detachably mounted on the drum cartridge 25.

The drum cartridge 25 includes the photosensitive drum 28, a charger 29, and a transfer roller 30.

The photosensitive drum 28 has a main drum body 32, and a metal drum shaft 33. The main drum body 32 is cylindrical in shape and has an outermost layer configured of a positive-charging photosensitive coating formed of polycarbonate or the like. The drum shaft 33 is provided in an axial center of the main drum body 32 and extends in a longitudinal direction of the main drum body 32.

Figure 5:
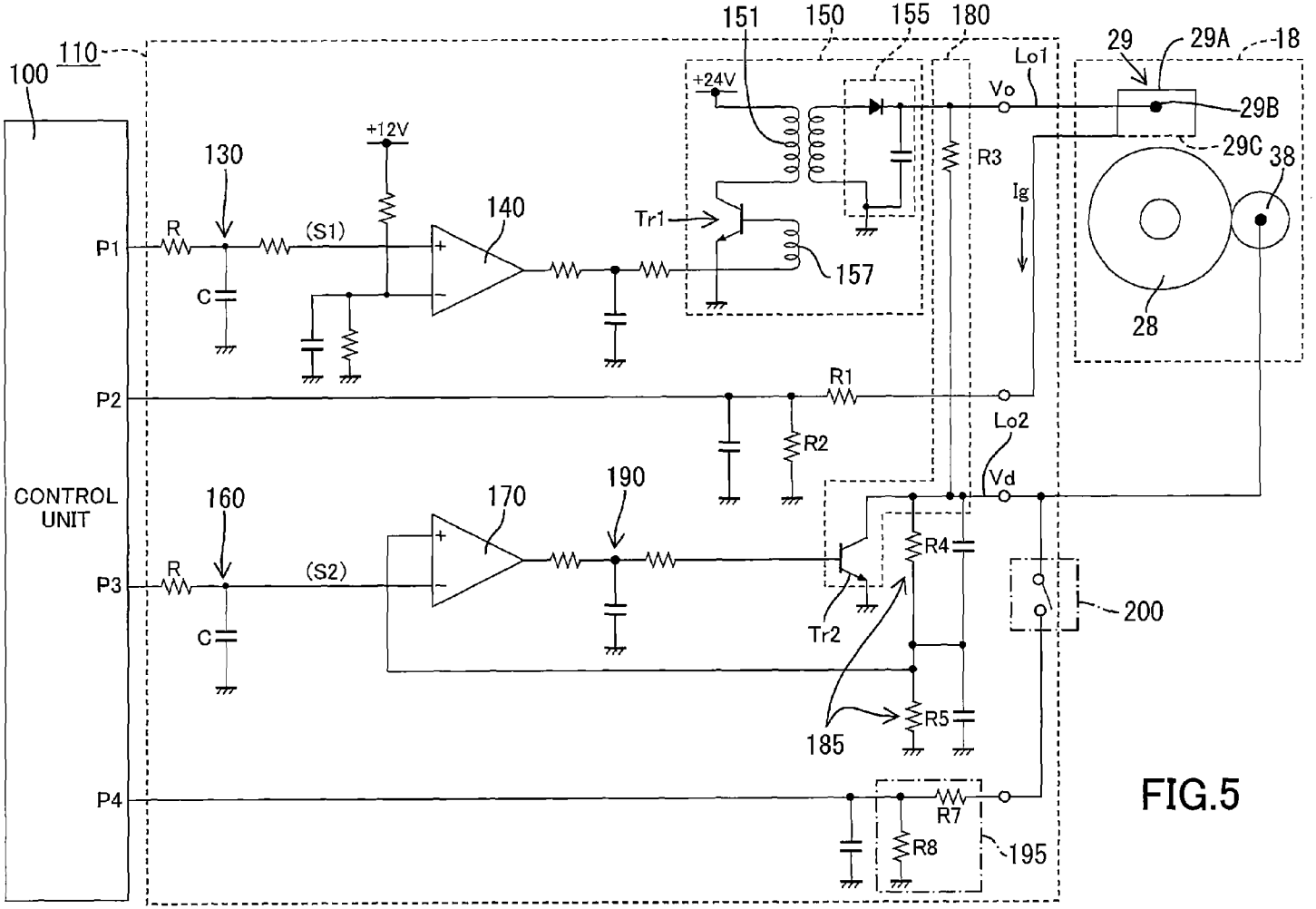
FIG. 5 is a circuit diagram for a high-voltage power supply circuit employed in the laser printer.

The charger 29 is a positive-charging scorotron charger that is adapted to generate a corona discharge from a discharging wire formed of tungsten or the like. The charger 29 includes a shield case 29A, a wire 29B, and a metal grid electrode 29C (FIG. 5). The shield case 29A has a square cylindrical shape and is elongated in an axial direction of the photosensitive drum 28. The shield case 29A is formed with an opening at a side opposing the photosensitive drum 28. The opening serves as a discharge opening.

The wire 29B is configured of a tungsten wire, for example. The wire 29B is stretched taut across an inside of the shield case 29A along the axial direction. A charging voltage application circuit 150 (described later, FIG. 5) applies a high voltage to the wire 29B, by which the wire 29B produces a corona discharge within the shield case 29A. Ions produced in the corona discharge flow out of the discharge opening toward the photosensitive drum 28 in a discharge current and apply a uniform positive charge to the surface of the photosensitive drum 28.

The transfer roller 30 vertically opposes and contacts a bottom surface of the photosensitive drum 28, forming a nip with the photosensitive drum 28. During a transfer operation, a transfer bias is applied to the transfer roller 30.

The developer cartridge 26 includes a supply roller 37, a developing roller 38, and an agitator 43. The interior of the developer cartridge 26 is divided into a toner-accommodating chamber 41, and a developing chamber 42.

The toner-accommodating chamber 41 serves to accommodate toner therein. A toner discharge opening 45 is formed in a developing chamber 42 side of the toner-accommodating chamber 41. The agitator 43 is disposed inside the toner-accommodating chamber 41. The agitator 43 is adapted to rotate about an agitator shaft 44 for agitating the toner in the toner-accommodating chamber 41 while discharging the toner into the developing chamber 42 through the toner discharge opening 45. The developing chamber 42 accommodates the supply roller 37 and the developing roller 38 therein.

The supply roller 37 includes a metal supply roller shaft 46, and a sponge roller 47. The sponge roller 47 is formed of an electrically conductive foam material and covers an outside of the supply roller shaft 46.

The developing roller 38 includes a roller shaft 48, and a rubber roller 49. The rubber roller 49 is formed of an electrically conductive rubber material and covers an outside of the roller shaft 48. The developing roller 38 is adapted to receive toner supplied from the supply roller 37, to positively charge the toner with a developing voltage Vd applied to the developing roller 38, and to supply the positively charged toner onto the surface of the photosensitive drum 28.

The fixing unit 19 includes a heating roller 52, and a pressure roller 53. A heater 75 configured of a halogen lamp is built inside the heating roller 52 and extends along an axial direction thereof. The heater 75 is adapted to heat the surface of the heating roller 52 to a fixing temperature. After the photosensitive drum 28 transfers the toner onto the surface of the sheet 3, the fixing unit 19 fixes the toner to the sheet 3 by heat while the sheet 3 passes between the heating roller 52 and the pressure roller 53.

Next, an image forming process in the printer 1 having the above construction will be described. The printer 1 begins a printing process upon receiving print data (see FIG. 4). The charger 29 uniformly positively charges the surface of the photosensitive drum 28 as the photosensitive drum 28 rotates. The scanning unit 17 irradiates a laser beam onto the surface of the photosensitive drum 28, forming a desired electrostatic latent image on the surface based on the print data. That is, the electric potential in areas on the positively charged surface of the photosensitive drum 28 exposed to the laser beam is lowered.

The positively charged toner carried on the surface of the developing roller 38 is supplied to the electrostatic latent image formed on the surface of the photosensitive drum 28 as the developing roller 38 rotates. The toner develops the electrostatic latent image into a visible toner image through reverse development.

In the meantime, the printer 1 performs a process to convey the sheet 3 in parallel to the process for forming a toner image. More specifically, the rotating pickup roller 11 picks up the sheets 3 in the paper tray 8 and feeds the sheets 3 onto a paper-conveying path one sheet at a time. The feeding roller 9 conveys each sheet 3 fed onto the paper-conveying path to a transfer position (a position where the photosensitive drum 28 and the transfer roller 30 contact each other).

As the sheet 3 passes through the transfer position, a transfer bias applied to the transfer roller 30 causes the toner image carried on the surface of the photosensitive drum 28 to be transferred onto the surface of the sheet 3, thereby forming a toner image on the sheet 3. The toner image transferred onto the sheet 3 is subsequently fixed to the sheet 3 by heat as the sheet 3 passes through the fixing unit 19. Upon exiting the fixing unit 19, the sheet 3 is conveyed along a vertically extending discharge path 62 upward toward the top surface of the main casing 2. Discharge rollers 57 provided at a top end of the discharge path 62 receive the sheet 3 conveyed along the discharge path 62 and discharge the sheet 3 onto the discharge tray 58 formed on the top surface of the main casing 2.

2. Electrical Structure of Printer

Next, an electrical structure of the printer 1 will be described.

The printer 1 includes a main motor 96, a laser drive circuit 73 for driving the laser light source, the heater 75 for heating the heating roller 52, a high-voltage power supply circuit 110 for generating a charging voltage (output voltage) Vo to be applied to the charger 29, and for generating the developing voltage Vd to be applied to the developing roller 38, a communication unit 81, a RAM 83, a ROM 85, and a control unit 100. The main motor 96 is adapted to drive rotation of rotary bodies in the process cartridge 18, such as the photosensitive drum 28, the developing roller 38, the agitator 43, and the supply roller 37; and rotary bodies in the paper-conveying system, such as the feeding roller 9 and the pickup roller 11.

The communication unit 81 enables the printer 1 to communicate with a PC or other data terminal and is adapted to receive print commands and print data from the data terminals. The ROM 85 is adapted to store a program for implementing a printing process, a program for implementing a new cartridge detection process in a determination mode (described later) for determining whether the process cartridge 18 is new, and the like. The RAM 83 is also adapted to store various data.

The control unit 100 is adapted to implement overall functions of the printer 1 during an image forming process, functions to control the high-voltage power supply circuit 110, and functions to determine the usage state of the process cartridge 18. In the depicted embodiment, the control unit 100 functions to determine whether the process cartridge 18 is new or used.

The printer 1 according to the present embodiment uses the developing voltage Vd generated by the high-voltage power supply circuit 110 to electrically detect whether the process cartridge 18 is new or used. To illustrate how the printer 1 electrically detects the usage state of the process cartridge 18, first the circuitry of the high-voltage power supply circuit 110 will be described, after which a new cartridge detection method performed by the printer 1 to determine whether the process cartridge 18 is new or used will be described.

3. Configuration of High-Voltage Power Supply Circuit

As shown in FIG. 5, the high-voltage power supply circuit 110 includes a first PWM signal smoothing circuit 130, an op-amp 140, the charging voltage application circuit 150, a second PWM signal smoothing circuit 160, an op-amp 170, and a developing voltage application circuit 180.

The first PWM signal smoothing circuit 130 is an integrator circuit configured of a resistor R, and a capacitor C. The first PWM signal smoothing circuit 130 is adapted to smooth a PWM signal S1 outputted from a PWM port P1 of the control unit 100. The op-amp 140 is provided in an output stage of the first PWM signal smoothing circuit 130. After being smoothed and amplified by the first PWM signal smoothing circuit 130 and the op-amp 140, respectively, the PWM signal S1 is inputted into a base of a transistor Tr1 provided in the charging voltage application circuit 150.

The charging voltage application circuit 150 is adapted to generate a high voltage of about 6-8 kV from a DC 24 V input voltage and to apply this high voltage to the charger 29.

In this embodiment, a self-oscillating flyback converter (ringing choke converter) is employed as the charging voltage application circuit 150. The charging voltage application circuit 150 includes a transformer 151, a rectifying and smoothing circuit 155 provided on a secondary coil side of the transformer 151, and the transistor Tr1 provided on a primary coil side of the transformer 151.

The transistor Tr1 serves as a switch for the transformer 151. An emitter of the transistor Tr1 is connected to ground. A collector of the transistor Tr1 is connected to a primary coil of the transformer 151, and the base of the transistor Tr1 is connected to an output terminal of the op-amp 140 via a sub-coil (feedback coil) 157 to the primary coil of the transformer 151.

The wire 29B of the charger 29 is connected to an output line Lo1 of the charging voltage application circuit 150. This configuration enables the printer 1 to apply the output voltage Vo of the charging voltage application circuit 150 to the wire 29B of the charger 29.

Additionally, the grid electrode 29C of the charger 29 is connected to ground via resistors R1 and R2. A signal line connects a point of connection between the resistors R1 and R2 to an input port P2 of the control unit 100. Thus, the control unit 100 can monitor a voltage level at the input port P2 to determine a magnitude of a grid current Ig flowing in the grid electrode 29C of the charger 29.

By adjusting a duty cycle of the PWM signal S1 outputted from the PWM port P1 while monitoring the voltage level at the input port P2, the control unit 100 can adjust the output voltage Vo of the charging voltage application circuit 150 in order to maintain the grid current Ig flowing to the grid electrode 29C of the charger 29 at a reference value (250 μA, for example).

The developing voltage application circuit 180 is adapted to apply the developing voltage Vd to the roller shaft of the developing roller 38. The developing voltage application circuit 180 includes a resistor R3 and a control transistor Tr2. One end of the resistor R3 is connected to the output line Lo1 of the charging voltage application circuit 150.

The control transistor Tr2 is an NPN transistor. A collector of the control transistor Tr2 is connected to another end of the resistor R3 (i.e. an end not connected to the output line Lo1), while an emitter of the control transistor Tr2 is connected to ground. An output line Lo2 runs from a connection point between the control transistor Tr2 and the resistor R3 and is connected to the roller shaft of the developing roller 38. With this construction, the developing voltage Vd applied to the developing roller 38 can be controlled by adjusting the voltage applied to a base of the control transistor Tr2.

Note that the developing voltage Vd applied to the developing roller 38 is a voltage obtained by subtracting an amount of voltage drop across the resistor R3 from the output voltage Vo of the charging voltage application circuit 150.

In the present embodiment, the second PWM signal smoothing circuit 160, a developing voltage detection circuit 185, and the op-amp 170 are used to control the developing voltage Vd outputted from the developing voltage application circuit 180 through a hardware configuration.

More specifically, the control unit 100 is adapted to set a target voltage for the developing voltage Vd and outputs this target voltage in the form of a PWM signal S2 from a PWM port P3. The second PWM signal smoothing circuit 160 is an integrator circuit configured of a resistor R, and a capacitor C. The second PWM signal smoothing circuit 160 is adapted to smooth the PWM signal S2 outputted from the PWM port P3 of the control unit 100.

The developing voltage detection circuit 185 is adapted to detect the developing voltage Vd. In the present embodiment, the developing voltage detection circuit 185 is configured of resistors R4 and R5 connected in series. The resistors R4 and R5 are connected between the output line Lo2 of the developing voltage application circuit 180 and ground. The voltage generated at each of the resistors R4 and R5 is obtained by dividing the developing voltage Vd by their resistance ratio.

The second PWM signal smoothing circuit 160 is connected to a minus input terminal of the op-amp 170, while a signal line leading from a point of connection between the resistors R4 and R5 is connected to a plus input terminal. An output terminal of the op-amp 170 is connected to the base of the control transistor Tr2 via a smoothing circuit 190.

The op-amp 170 amplifies a difference between the developing voltage Vd detected by the developing voltage detection circuit 185 and the target voltage set by the control unit 100, and outputs a resulting signal to the base of the control transistor Tr2. For example, when the detected developing voltage Vd is higher than the target voltage, the control transistor Tr2 serves to increase the current flowing to the resistor R3. As a result, the developing voltage Vd is adjusted downward toward the target voltage. When the detected developing voltage Vd is lower than the target voltage, on the other hand, the control transistor Tr2 serves to reduce the current flowing to the resistor R3. As a result, the developing voltage Vd is adjusted upward toward the target voltage. Through this configuration, the developing voltage Vd can be automatically adjusted to the target voltage. Capacitors connected in parallel to the resistors R4 and R5 serve to stabilize circuit behavior.

An input port P4 of the control unit 100 is electrically connected to the output line Lo2 of the developing voltage application circuit 180 via a contact 200. While this will be described later in detail, when the main motor 96 is driven, the contact 200 is configured to switch on or off based on whether the process cartridge 18 is new or used. Hence, the control unit 100 can determine whether the process cartridge 18 is new or used by monitoring a voltage at the input port P4 while rotating the main motor 96.

A voltage-dividing circuit 195 is provided between the input port P4 and the contact 200. The voltage-dividing circuit 195 is configured of resistors R7 and R8. The developing voltage Vd outputted from the developing voltage application circuit 180 is divided by the resistance ratio of the resistors R7 and R8 and inputted into the input port P4 of the control unit 100.

4. Mechanism for Switching Contact 200 On and Off

Figure 6A:
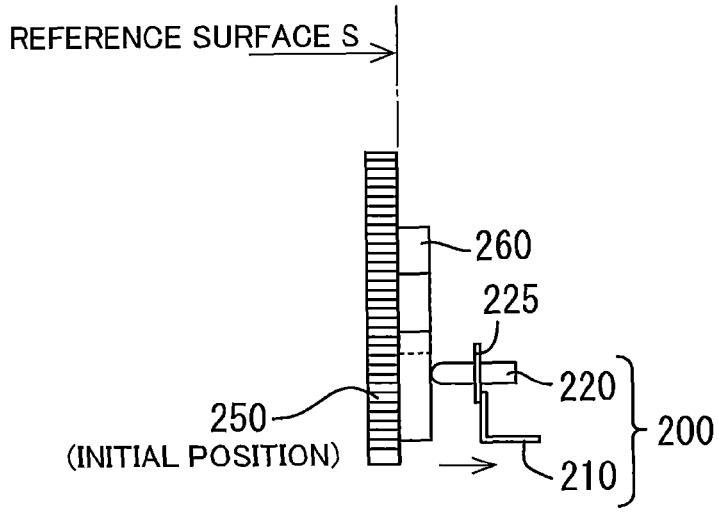
Figure 6B:
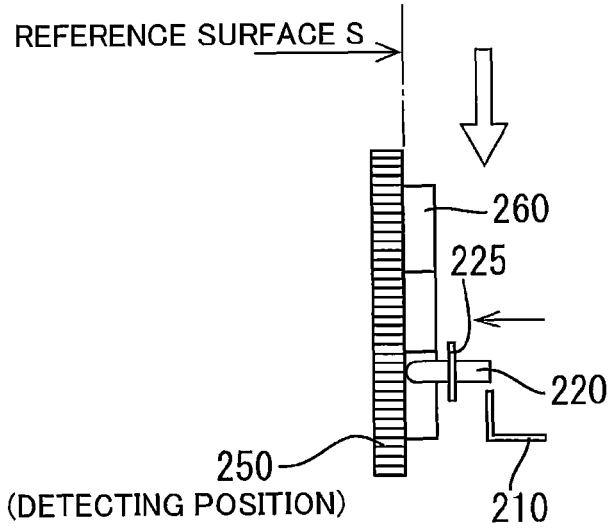
Figure 6C:
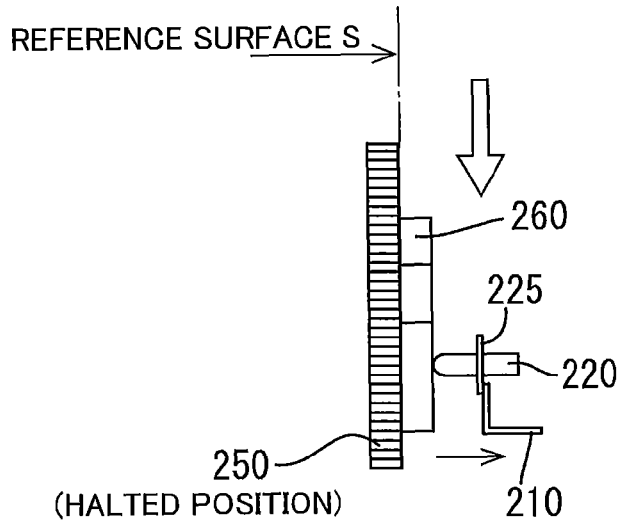

As shown in FIG. 6A, the contact 200 is configured of a stator 210 and a mover 220. The contact 200 is rendered ON (closed circuit) when the stator 210 and mover 220 are connected to each other, as illustrated in FIGS. 6A and 6C, and shut OFF (open circuit) when the mover 220 is separated from the stator 210, as illustrated in FIG. 6B.

The stator 210 is configured of an L-shaped metal piece, for example. The mover 220 is formed of a cylindrical metal rod, for example, and has a flange part 225 around its circumference.

The contact 200 configured of this stator 210 and mover 220 is mounted in the main casing 2 such that a distal end of the mover 220 (a left end thereof in FIGS. 6A through 6C) faces a side surface of the process cartridge 18. A spring (not shown) in the main casing 2 urges the mover 220 in a direction for separating the flange part 225 from the stator 210, i.e., toward the process cartridge 18 (leftward in FIGS. 6A through 6C).

The switching gear 250 is fixed in a side wall 26A (see FIG. 8) of the developer cartridge 26 so as to be non-rotatable relative to the same. The switching gear 250 has a toothed part 253 formed around its circumference. The toothed part 253 covers approximately 300 degrees of the circumferential surface of the switching gear 250. Remaining approximate 60 degrees worth of the circumference does not have teeth. The toothed part 253 is configured to be engaged with inner teeth 65A of an agitator drive gear 65 (see FIG. 7).

Figure 8:
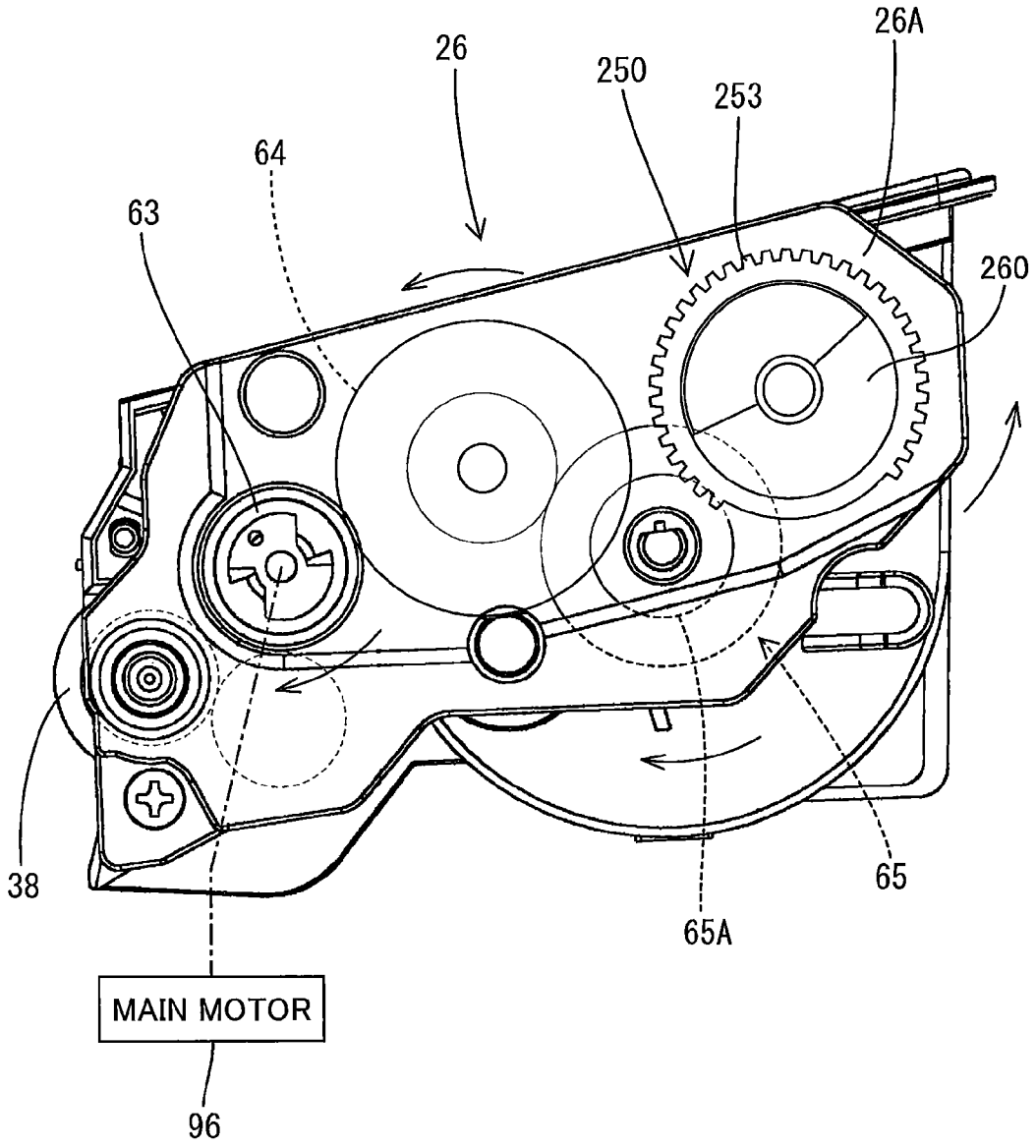
FIG. 8 is a side view of a developer cartridge.

In addition to the switching gear 250, an input gear 63, an intermediate gear 64, the agitator drive gear 65, and the like are provided on the side wall 26A of the developer cartridge 26, as illustrated in FIG. 8. These gears are engaged with one another and constitute a drive system. When the main motor 96 rotates, a drive force generated by the main motor 96 is transmitted to the switching gear 250 via the input gear 63, the intermediate gear 64, and the agitator drive gear 65. Thus, this drive system rotates the switching gear 250 as the main motor 96 rotates. The main motor 96 drives the agitator 43 to rotate via the agitator drive gear 65, and rotates the rotary bodies of the process cartridge 18, such as the photosensitive drum 28 and the developing roller 38.

Figure 7A:
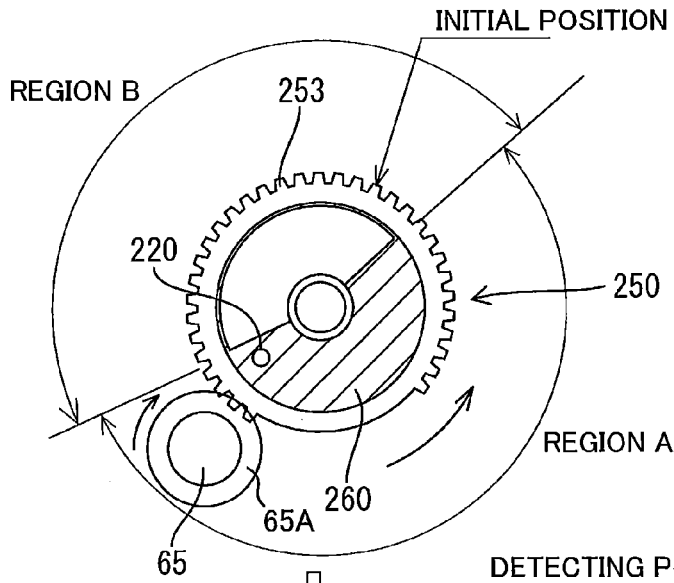
Figure 7B:
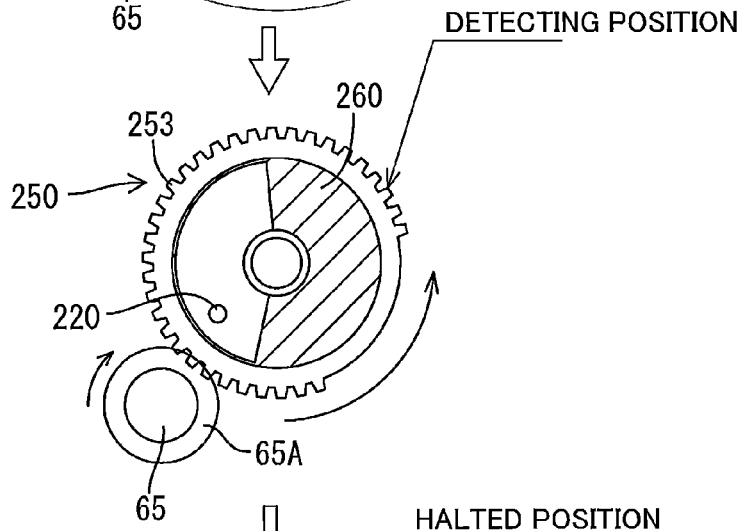
Figure 7C:
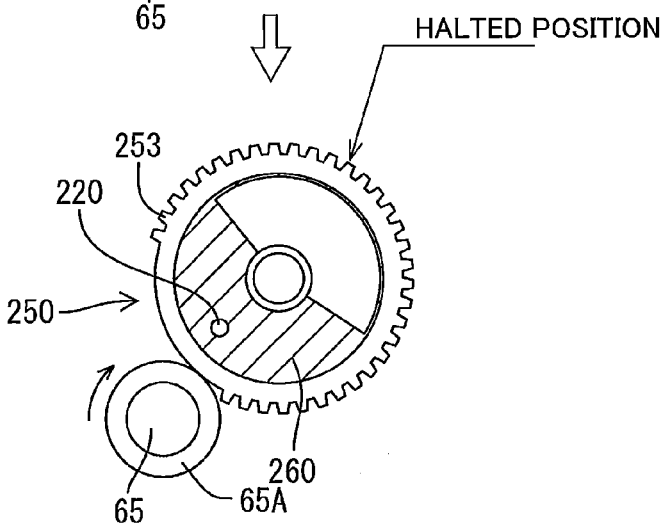

As shown in FIGS. 6A through 7C, a pressing part 260 is also provided on an end face of the switching gear 250. The pressing part 260 constitutes a step part on the end face of the switching gear 250 that protrudes farther toward the stator 210 than a reference surface S of the switching gear 250, and is adapted to press the mover 220 toward the stator 210. As shown in FIGS. 7A through 7C, the pressing part 260 is provided only over a region A (a shaded region). A region B that constitutes the end face of the switching gear 250 outside the region A is the reference surface S.

With this configuration, the mover 220 rides up on the pressing part 260 when in the region A, as shown in FIGS. 7A and 7C. In this state, the mover 220 is pressed toward the stator 210 by the pressing part 260, as shown in FIGS. 6A and 6C. Accordingly, the flange part 225 of the mover 220 contacts the stator 210, placing the contact 200 in its ON state (closed state).

On the other hand, when the mover 220 is in the region B outside the region A, as shown in FIG. 7B, an urging force of the spring (not shown) separates the mover 220 from the stator 210, as shown in FIG. 6B, placing the contact 200 in its OFF state (open state).

In the present embodiment, when the process cartridge 18 is new (unused), the switching gear 250 is subjected to positioning at an initial position shown in FIG. 7A. Hence, when the new process cartridge 18 is mounted in the main casing 2, the mover 220 is in the region A and rides up on the pressing part 260, switching the contact 200 to its ON state, as shown in FIG. 6A. Further, when the switching gear 250 is at the initial position, the toothed part 253 formed on the circumference of the switching gear 250 is engaged with the agitator drive gear 65. Consequently, when the main motor 96 begins to rotate, the switching gear 250 begins to rotate counterclockwise in FIG. 8 as a result of the input gear 63 rotating clockwise, the intermediate gear 64 rotating counterclockwise, and the agitator drive gear 65 rotating clockwise.

Figure 9:
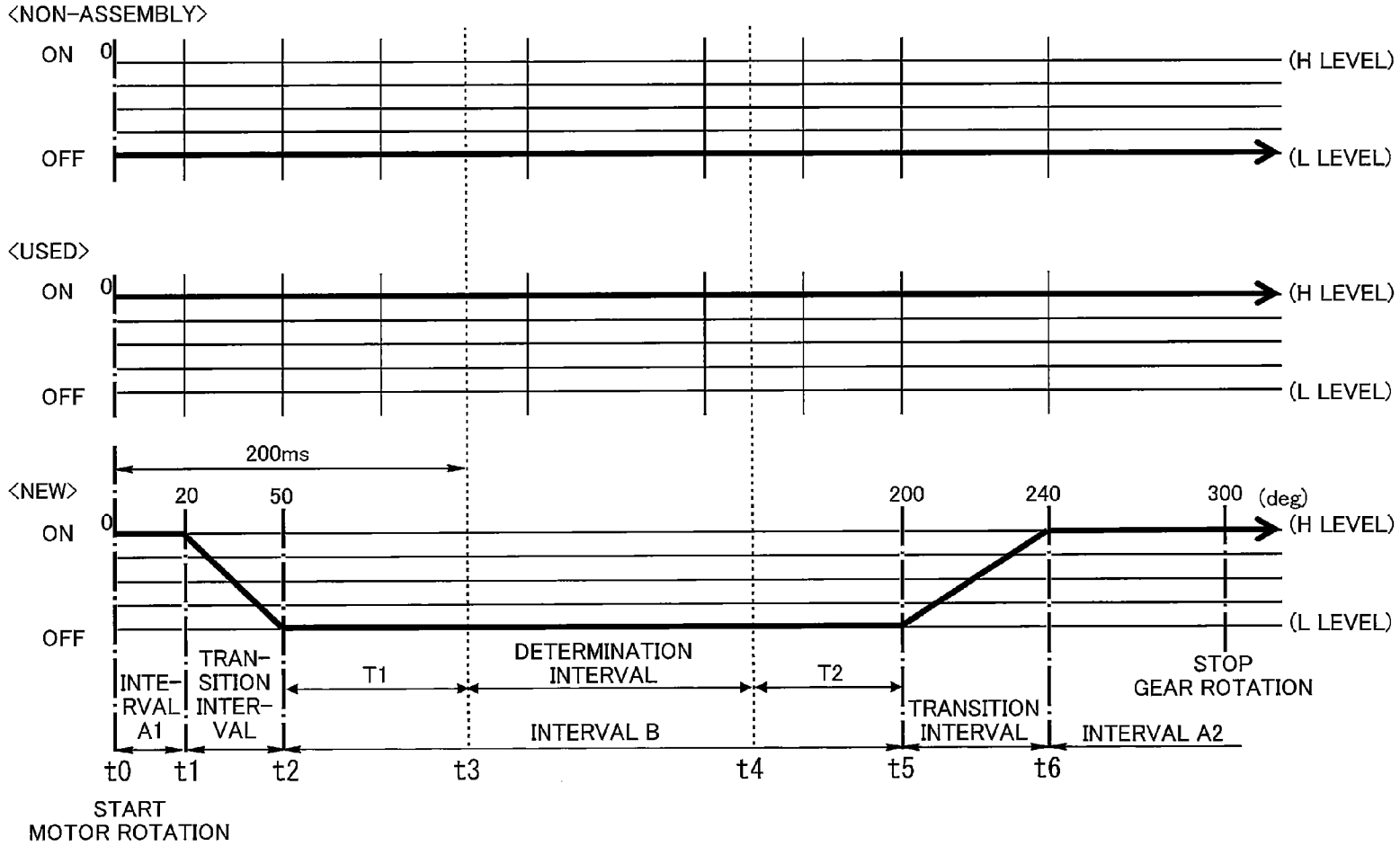
FIG. 9 is a timing chart showing the ON/OFF states of the contact.

After the switching gear 250 begins to rotate, the contact 200 is maintained in its ON state, while the mover 220 moves within the region A corresponding to an interval A1 in FIG. 9, which is the region in which the pressing part 260 is formed. As the switching gear 250 continues to rotate, the mover 220 transfers from the region A to the region B, as shown in FIG. 7B. That is, the pressing part 260 rotates out from under the mover 220 so that the mover 220 drops back against the side surface of the switching gear 250. At this time, the mover 220 is in the region B and the switching gear 250 is at a detecting position. The contact 200 remains in an OFF state, as shown in FIG. 6B, while the mover 220 remains off the pressing part 260, which corresponds to an interval B in FIG. 9.

As the switching gear 250 continues to rotate, the mover 220 once again enters the region A in which the pressing part 260 is formed and, hence, once again rides up on the pressing part 260, causing the contact 200 to switch from the OFF state to the ON state. When the switching gear 250 has rotated to a halted position shown in FIG. 7C, the toothed part 253 formed on the circumference of the switching gear 250 disengages from the agitator drive gear 65. Hence, when the switching gear 250 arrives at the halted position, the switching gear 250 no longer rotates even when the main motor 96 rotates. Therefore, the contact 200 is maintained in its ON state, as shown in FIG. 6C, after the mover 220 once again enters the region A (during an interval A2 in FIG. 9).

With this configuration, the contact 200 is initially in the ON state when the new process cartridge 18 is first mounted in the main casing 2. Subsequently, the main motor 96 begins to rotate, driving the switching gear 250 to rotate out of its initial position. The contact 200 is maintained in the ON state for a fixed interval (the interval A1 in FIG. 9) after the switching gear 250 begins to rotate. Next, the contact 200 shifts temporarily to its OFF state when the mover 220 separates from the pressing part 260 (the interval B in FIG. 9). As the main motor 96 continues to rotate, the contact 200 returns to the ON state and is maintained in the ON state thereafter (the interval A2 in FIG. 9).

On the other hand, when the process cartridge 18 mounted in the main casing 2 is used, i.e., has performed image formation even one time, the switching gear 250 of the process cartridge 18 is already at the halted position shown in FIG. 7C. Therefore, the contact 200 remains constantly in the ON state since the switching gear 250 of the used process cartridge 18 never rotates out of the halted position shown in FIG. 7C, even when the main motor 96 rotates.

Accordingly, the control unit 100 can determine whether the process cartridge 18 is new or used by monitoring the voltage at the input port P4 while rotating the main motor 96.

Specifically, in the case of a used process cartridge 18, the contact 200 remains constantly in the ON state after the main motor 96 begins to rotate (timing t0 in FIG. 9). Consequently, the voltage at the input port P4 is continuously at the high level due to the voltage outputted from the developing voltage application circuit 180. In the case of a new process cartridge 18, on the other hand, the contact 200 switches off for a fixed interval after the initial rotation of the main motor 96 (the interval B between timings t2 and t5 in FIG. 9) while the mover 220 is separated from the pressing part 260. During this interval, the voltage at the input port P4 is at the low level. Hence, the control unit 100 can determine whether the process cartridge 18 is new or used by monitoring the voltage at the input port P4 during the fixed interval after the initial rotation of the main motor 96.

In the present embodiment, the mover 220 is positioned in the region A of the switching gear 250 during the interval A1 (between timings t0 and t1 in FIG. 9) in which the switching gear 250 rotates 20 degrees from its initial rotational angle of 0 degrees, and during the interval A2 (the interval following timing t6 in FIG. 9) after the switching gear 250 has rotated 240 degrees from its initial position. Further, the mover 220 is in the region B during the interval B (between timings t2 and t5 in FIG. 9) while the rotational angle of the switching gear 250 is between 50 degrees and 200 degrees from its initial position.

Accordingly, the control unit 100 can determine whether the process cartridge 18 is new or used by monitoring the voltage at the input port P4 during the interval B as a determination interval.

However, the intervals before and after the interval B (i.e., intervals t1-t2 and t5-t6 in FIG. 9) are transition intervals in which the contact 200 is switched between its ON and OFF states. Consequently, the connection state of the contact 200 during the transition intervals and before and after the transition intervals may be unstable. Thus, in the present embodiment, the control unit 100 does not check the voltage at the input port P4 for a prescribed time T1 after the contact 200 has switched from the ON state to the OFF state (timing t2 in FIG. 9) and until a timing at which the stability of the connection state in the contact 200 can be ensured (timing t3 in FIG. 9).

Similarly, the control unit 100 does not check the voltage at the input port P4 for a prescribed time T2 after a timing at which the stability of the connection state in the contact 200 can no longer be ensured due to the effects of the contact 200 shifting from the OFF state to the ON state (timing t4 in FIG. 9) and until a timing at which the contact 200 begins to shift from the OFF state to the ON state (timing t5 in FIG. 9).

In other words, the determination interval during which the control unit 100 monitors the voltage at the input port P4 is the interval from a timing (timing t3 in FIG. 9) at which the stability of the connection state in the contact 200 can be ensured to a timing (timing t4 in FIG. 9) at which the stability can no longer be ensured. In this way, the control unit 100 can accurately detect the usage state of the process cartridge 18.

5. Determination Mode

In addition to a print mode for performing an image forming operation (i.e., for printing), the printer 1 of the present embodiment is provided with a special determination mode for performing an operation to determine whether the process cartridge 18 is new or used. The printer 1 is also provided with a sensor (not shown) for detecting when the cover 7 is closed, which occurs after the process cartridge 18 is replaced, for example. When the sensor detects that the cover 7 is closed or when the control unit 100 first starts up after the power to the printer 1 is turned on, the printer 1 executes the new cartridge detection process in the determination mode prior to performing a printing process in the print mode. Next, the new cartridge detection process in the determination mode will be described with reference to FIG. 10.

Figure 10:
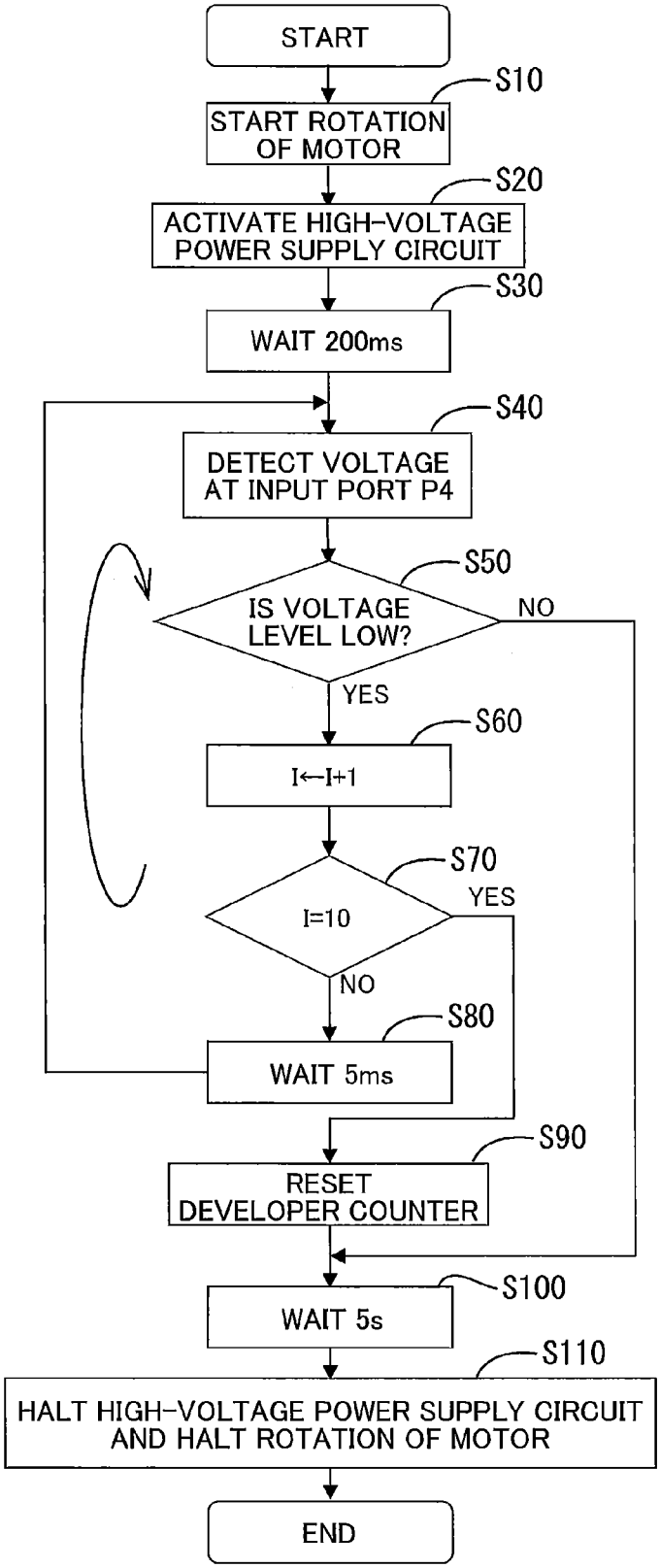
FIG. 10 is a flowchart illustrating steps in a new cartridge detection process performed by the laser printer in a determination mode.

After entering the determination mode, in S10 of FIG. 10 the control unit 100 controls the main motor 96 to begin rotating. In S20 the control unit 100 activates the high-voltage power supply circuit 110. When activated, the high-voltage power supply circuit 110 applies the charging voltage Vo to the charger 29 via the charging voltage application circuit 150 and applies the developing voltage Vd to the developing roller 38 via the developing voltage application circuit 180.

In the determination mode, the control unit 100 sets the charging voltage Vo to be applied by the charging voltage application circuit 150 to the charger 29 higher than the charging voltage Vo applied during the print mode. As an example, the control unit 100 may set the charging voltage Vo to approximately 6.8 kV in the print mode and to 7 kV in the determination mode.

In the determination mode, the control unit 100 also sets the developing voltage Vd to be applied by the developing voltage application circuit 180 to the developing roller 38 lower than the developing voltage Vd applied during the print mode. As an example, the control unit 100 may set the developing voltage Vd to 500 V in the print mode and to 150 V in the determination mode.

The control unit 100 sets the charging voltage Vo and the developing voltage Vd by modifying the value of the PWM signal outputted from the PWM ports P1 and P3.

In S30 the control unit 100 waits 200 ms after initiating rotation of the main motor 96 before advancing to S40. In S40 the control unit 100 executes a process to detect the voltage at the input port P4. The 200 ms delay is performed in S30 to adjust the timing at which the voltage is detected in S40, so that the control unit 100 can detect the voltage during the determination interval in FIG. 9. Thus, the delay time corresponds to the time from timing t0 to timing t3 in FIG. 9.

In S50 the control unit 100 performs a first determination process to determine the usage state of the process cartridge 18 based on the voltage level at the input port P4 detected in S40. Here, the control unit 100 determines that the process cartridge 18 is used when the voltage level is high and that the process cartridge 18 is new when the voltage level is low.

If the control unit 100 determines that the process cartridge 18 is new (S50: YES), in S60 the control unit 100 increments by 1 the value of a variable I indicating the number of times the process cartridge 18 was determined to be new. In S70 the control unit 100 determines whether the value of the variable I is 10. Since the variable I has an initial value of 0 at the beginning of the process, the control unit 100 determines that the value of the variable I is not 10 after performing the first determination process (S70: NO). In S80 the control unit 100 waits 5 ms before returning to S40.

In S40 the control unit 100 repeats the process to detect a voltage at the input port P4. In S50 the control unit 100 executes a second determination process for determining whether the process cartridge 18 is new.

Since the contact 200 remains in the OFF state during the determination interval when the process cartridge 18 mounted in the printer 1 is new (S50: YES), in S60 the control unit 100 increments by 1 the value of the variable I and in S70 again determines whether the value of the variable I is 10.

By repeatedly performing the processes in S40, S50, S70, and S80 in this way, the control unit 100 repeatedly determines the usage state of the process cartridge 18 during the determination interval shown in FIG. 9.

When the control unit 100 determines that the process cartridge 18 is new in S50 a total of 10 consecutive times, the control unit 100 will determine in S70 that the value of the variable I equals 10 (S70: YES). At this time, the control unit 100 exits the loop of S40-S80 and advances to S90. The new cartridge detection process of S50 is performed a plurality of times to prevent the effects of noise or the like from producing an incorrect determination if the determination were performed only one time.

In S90 the control unit 100 resets a developer counter (not shown) to 0. The developer counter serves to count the number of sheets that are printed with the current process cartridge 18. The number of printed sheets is counted to estimate how much the toner in the process cartridge 18 has degraded and to determine when the process cartridge 18 needs to be replaced. The control unit 100 resets the developer counter in S90 in order to begin counting from 0 when a new process cartridge 18 is first mounted in the printer 1.

In S100 the control unit 100 waits 5 s before advancing to S110. In S110 the control unit 100 executes a process to halt the high-voltage power supply circuit 110 and a process to halt rotation of the main motor 96. At this point, the new cartridge detection process in the determination mode ends.

On the other hand, when the control unit 100 determines in S50 that the process cartridge 18 is used (S50: NO), the control unit 100 skips the processes in S60-S90 and advances directly to S100.

6. Effects of Embodiment

Since the printer 1 of the present embodiment electrically detects the usage state of the process cartridge 18, as described above, the photo-interrupter used in conventional apparatuses can be eliminated. Moreover, the printer 1 electrically detects the usage state of the process cartridge 18 using output from the high-voltage power supply circuit 110, thereby achieving a simpler power structure than an apparatus that provides a separate power supply for detection. Accordingly, the present invention can reduce the number of parts in the apparatus, allowing for a more compact apparatus.

In the present embodiment, the contact 200 is provided on the main casing 2 side rather than the process cartridge 18 side. Accordingly, the process cartridge 18, which is a replaceable component, can be made smaller.

Further, since the printer 1 can electrically detect whether the process cartridge 18 is new or used based on changes in voltage occurring when the contact 200 switches on and off, it is technologically feasible to use output from the charging voltage application circuit 150 for this detection, for example. However, the voltage inputted into the input port P4 would be higher since the charging voltage Vo is around 7-7.5 kV.

The printer 1 according to the present embodiment uses output from the developing voltage application circuit 180 to electrically detect whether the process cartridge 18 is new or used. Since the output voltage from the developing voltage application circuit 180 is around 150-540 V, which is considerably lower than the output voltage from the charging voltage application circuit 150, this configuration can reduce the voltage inputted into the input port P4 and reduce the noise level. As a result, the printer 1 can accurately determine the voltage level at the input port P4 and, hence, can accurately determine whether the process cartridge 18 is new or used. Further, reducing the noise level is useful for protecting the control unit 100.

In the determination mode described in the present embodiment, the control unit 100 sets the developing voltage Vd to be applied to the developing roller 38 lower than the developing voltage Vd to be applied during the print mode, allowing the voltage inputted into the input port P4 to be further reduced. The addition of the voltage-dividing circuit 195 also can further reduce the input voltage to the input port P4.

In the present embodiment, the control unit 100 sets the charging voltage Vo to be applied to the charger 29 in the determination mode higher than the charging voltage Vo to be applied in the print mode. This setting obtains the following effects.

In the determination mode, a portion of the electrical current outputted from the charging voltage application circuit 150 flows to ground via the resistor R3, the contact 200, the resistor R7, and the resistor R8. As a result, the charging current flowing from the charging voltage application circuit 150 toward the charger 29 is likely to be insufficient.

By setting the charging voltage Vo slightly higher in the determination mode, as described in the present embodiment, the printer 1 can compensate for any lack in charging current flowing from the charging voltage application circuit 150 to the charger 29, ensuring that the charging current is sufficient for maintaining image quality during the determination mode. Accordingly, the printer 1 can immediately perform the printing process after exiting the determination mode. In this case, the printing process would be executed in S110 of FIG. 10 in place of the process for halting the high-voltage power supply circuit 110 and the main motor 96.

In the present embodiment, the contact 200 is in the OFF state when the process cartridge 18 is not mounted in the printer 1 and, hence, the voltage at the input port P4 is constantly at the low level, as indicated in the top timing chart of FIG. 9. However, when a new or used process cartridge 18 is mounted in the printer 1, the voltage of the input port P4 is constantly at the high level, except during the interval B in FIG. 9 for the case of the new process cartridge 18. Hence, the voltage level at the input port P4 can also be used to determine whether the process cartridge 18 is mounted in the printer 1, excluding the interval B in FIG. 9.

Variations of Embodiment

While the present invention has been described in detail with reference to the embodiment thereof, it would be apparent to those skilled in the art that various changes and modifications may be made therein without departing from the spirit of the present invention.

(1) After the new process cartridge 18 is mounted in the printer 1 in the above described embodiment, the contact 200 shifts from the ON state to the OFF state and subsequently returns to the ON state in response to the rotation of the main motor 96. However, the ON/OFF pattern of the contact 200 is not limited to the embodiment. For example, after the new process cartridge 18 is mounted in the printer 1, the contact 200 may be configured to switch from the OFF state to the ON state and subsequently return to the OFF state in response to the rotation of the main motor 96.

Figure 11A:
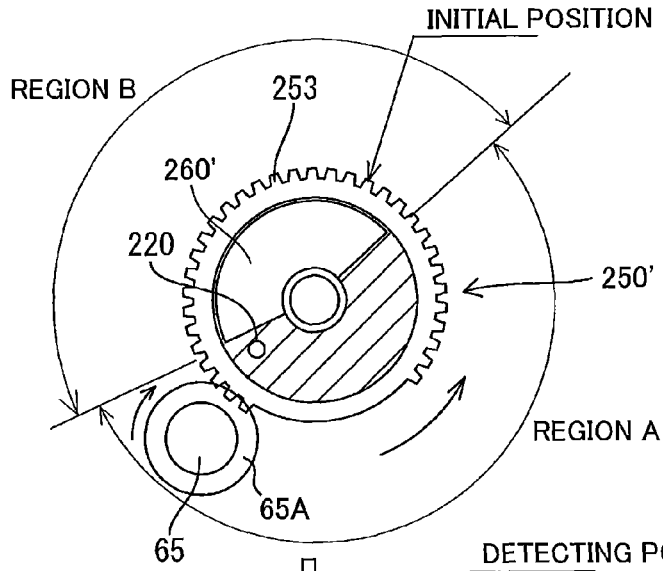
Figure 11B:
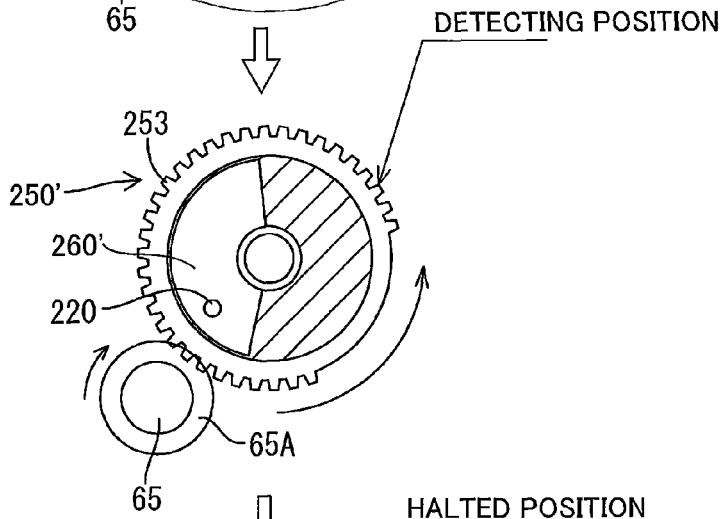
Figure 11C:
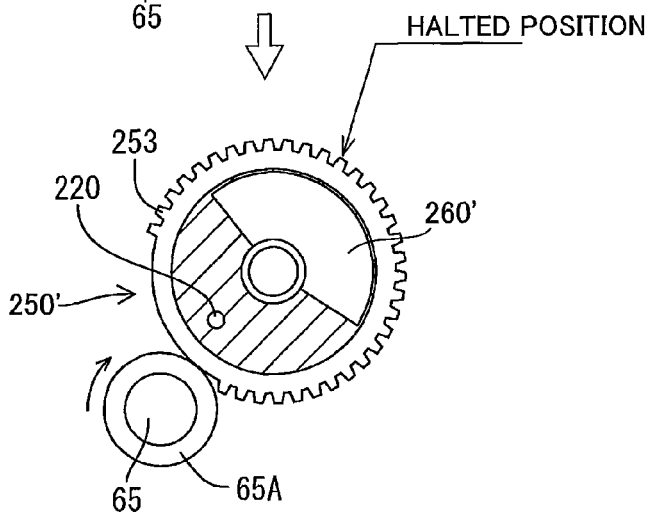

In this case, the printer 1 determines whether the process cartridge 18 is new or used based on the detection output of the detection unit (the voltage level at the input port P4) indicating that the contact 200 is on. Since the interval in which the contact 200 is off is longer than the interval in which the contact 200 is on with this configuration, power consumption can be reduced. Note that in order to use this ON/OFF pattern of the contact 200, the region in which a pressing part 260' is formed on a switching gear 250' is reversed from that of the embodiment. In other words, the pressing part 260' is formed in the region B and not in the region A, as shown in FIGS. 11A through 11C.

(2) In the above-described embodiment, the contact 200 is configured to switch on and off using the pressing part 260 provided on the switching gear 250 to move the mover 220 relative to the stator 210. However, various mechanisms may be employed to switch the ON/OFF state of the contact 200. For example, the ON/OFF state of the contact 200 may be switched by using a screw mechanism to convert the drive force of the main motor 96 to a linear drive force.

(3) In the above-described embodiment, the process cartridge 18 is configured to include both the drum cartridge 25 and the developer cartridge 26, but the process cartridge 18 may be configured to include only the developer cartridge 26. Further, the input port P4 of the control unit 100 is connected to the output line Lo2 via the contact 200 in the above-described embodiment, and changes in voltage accompanying changes in the ON/OFF state of the contact 200 are detected at the input port P4. In other words, the input port P4 of the control unit 100 is used to implement the function of the detection unit of the present invention. However, a voltage detection circuit or the like may be provided separately from the control unit 100, as long as the detection unit can detect changes in voltage that accompany changes in the ON/OFF state of the contact 200.

(4) In the above-described embodiment, output from the developing voltage application circuit 180 is controlled through a hardware configuration employing the op-amp 170, but the output may be controlled in software instead. In this case, the control unit 100 monitors the developing voltage Vd, and the developing voltage application circuit 180 is controlled by the control unit 100. This is convenient because a special detection resistor need not be provided as the developing voltage Vd can be detected using the resistor R8 of the voltage-dividing circuit 195.

(5) In the above-described embodiment, whether the mounted process cartridge 18 is new or used is determined. However, whether the mounted process cartridge 18 is suitable or unstable for the printer 1 may be determined.

In the above-described embodiment, when the mounted process cartridge 18 is new, the contact 200 is initially in the ON state, and shifted to the OFF state, and then returned to the ON state in association with rotation of the switching gear 250, and hence, the voltage at the input port P4 is initially at the high level, and changed to the low level, and then changed to the high level. When the mounted process cartridge 18 is used, the contact 200 remains constantly in the ON state since the switching gear 250 never rotates, and the voltage at the input port P4 is continuously at the high level. Thus, the control unit 100 can determine whether the mounted process cartridge 18 is new or used by monitoring the voltage at the input port P4.

On the other hand, in this variation, for example, the process cartridge 18 suitable for the printer 1 is provided with the switching gear 250 whereas the process cartridge 18 unsuitable for the printer 1 is not provided with the switching gear 250. The switching gear 250 is configured so as to be capable of rotating in association with rotation of the main motor 96. When the process cartridge 18 suitable for the printer 1 is mounted in the printer 1, the switching gear 250 rotates while the main motor 96 rotates, thereby, for example, initially rendering the contact 200 in the ON state, then in the OFF state, and then, in the ON state. Therefore, the voltage at the input port P4 is initially at the high level, then changed to the low level, and then, changed to the high level. When the process cartridge 18 unsuitable for the printer 1 is mounted in the printer 1, the contact 200 remains constantly in the OFF state, for example, since the switching gear 250 is not provided. Therefore, the voltage at the input port P4 is continuously at the low level. Hence, the control unit 100 can determine whether the process cartridge 18 is suitable or unsuitable by monitoring the voltage at the input port P4.

Note that, in this variation, the switching gear 250 may have a shape different from that described in the above embodiment, and the determination mode for the operation to determine whether the process cartridge 18 is suitable or unsuitable may be different from the determination mode described in the above embodiment for the operation to determine whether the process cartridge 18 is new or used.

Further, whether the color of the mounted process cartridge 18 is correct or not may also be determined.

What is claimed is:

1. An image forming apparatus comprising:

a main casing;

a process cartridge configured to be mounted in and removed from the main casing;

a voltage applying unit configured to generate a voltage and to apply the voltage to the process cartridge when mounted;

a contact configured to be switched between an ON state and an OFF state based on a usage state of the process cartridge when mounted;

an electric line configured to electrically connect the voltage applying unit to the process cartridge when mounted;

a detection unit configured to be electrically connected to the electric line via the contact and to provide either one of a first detection output corresponding to the ON state of the contact and a second detection output corresponding to the OFF state of the contact; and a control unit configured to execute a determination process in a determination mode for determining the usage state of the process cartridge when mounted based on either one of the first detection output and the second detection output of the detection unit, wherein, when the process cartridge is mounted in the main casing, the control unit enters the determination mode prior to starting an image forming operation, and wherein the voltage to be applied by the voltage applying unit to the process cartridge when mounted in the determination mode is set to be lower than the voltage to be applied by the voltage applying unit to the process cartridge during the image forming operation.

2. The image forming apparatus as claimed in claim 1, wherein the contact is provided at the main casing.

3. An image forming apparatus comprising:

a main casing;

a process cartridge configured to be mounted in and removed from the main casing;

a voltage applying unit configured to generate a voltage and to apply the voltage to the process cartridge when mounted;

a contact configured to be switched between an ON state and an OFF state based on a usage state of the process cartridge when mounted;

an electric line configured to electrically connect the voltage applying unit to the process cartridge when mounted;

a detection unit configured to be electrically connected to the electric line via the contact and to provide either one of a first detection output corresponding to the ON state of the contact and a second detection output corresponding to the OFF state of the contact;

a control unit configured to execute a determination process in a determination mode for determining the usage state of the process cartridge when mounted based on either one of the first detection output and the second detection output of the detection unit; and a voltage-dividing circuit including a set of resistors having a predetermined resistance ratio, the voltage-dividing circuit being configured to divide the voltage applied to the process cartridge when mounted by the predetermined resistance ratio and to input the divided voltage into the detection unit.

4. The image forming apparatus as claimed in claim 3, wherein the contact is provided at the main casing.

5. An image forming apparatus comprising:

a main casing;

a process cartridge configured to be mounted in and removed from the main casing;

a voltage applying unit configured to generate a voltage and to apply the voltage to the process cartridge when mounted;

a contact configured to be switched between an ON state and an OFF state based on a usage state of the process cartridge when mounted;

an electric line configured to electrically connect the voltage applying unit to the process cartridge when mounted;

a detection unit configured to be electrically connected to the electric line via the contact and to provide either one of a first detection output corresponding to the ON state of the contact and a second detection output corresponding to the OFF state of the contact; and a control unit configured to execute a determination process in a determination mode for determining the usage state of the process cartridge when mounted based on either one of the first detection output and the second detection output of the detection unit, wherein the process cartridge comprises:

a photosensitive body; and a developing unit configured to supply a developing agent to the photosensitive body and to be electrically connected to the electric line, and wherein the detection unit is configured to be electrically connected, via the contact, to the electric line to which the developing unit is connected, wherein the process cartridge further comprises a charger, wherein the voltage applying unit comprises a first circuit and a second circuit, the first circuit being configured to generate a charging voltage and to apply the charging voltage to the charger, the second circuit being configured to step-down the charging voltage to generate a developing voltage and to apply the developing voltage to the developing unit, and wherein the charging voltage to be applied by the first circuit to the charger in the determination mode is set to be higher than the charging voltage to be applied by the first circuit to the charger during an image forming operation.

6. The image forming apparatus as claimed in claim 5, wherein the contact is provided at the main casing.

7. An image forming apparatus comprising:

a main casing;

a process cartridge configured to be mounted in and removed from the main casing;

a voltage applying unit configured to generate a voltage and to apply the voltage to the process cartridge when mounted;

a contact configured to be switched between an ON state and an OFF state based on a usage state of the process cartridge when mounted;

an electric line configured to electrically connect the voltage applying unit to the process cartridge when mounted;

a detection unit configured to be electrically connected to the electric line via the contact and to provide either one of a first detection output corresponding to the ON state of the contact and a second detection output corresponding to the OFF state of the contact;

a control unit configured to execute a determination process in a determination mode for determining the usage state of the process cartridge when mounted based on either one of the first detection output and the second detection output of the detection unit;

a motor configured to generate a driving force, the driving force rotating rotary bodies constituting the process cartridge; and a switching unit configured to perform a switching operation for switching a connection state of the contact ON and OFF upon receipt of the driving force from the motor, and wherein the control unit executes the determination process when a predetermined period of time has been elapsed after the connection state of the contact is switched by the switching unit in response to a rotation of the motor while the control unit has been in the determination mode, wherein the contact is configured to switch from the OFF state to the ON state and subsequently return to the OFF state in response to the rotation of the motor after a new process cartridge is mounted in the main casing; and wherein the control unit is configured to determine that the process cartridge when mounted is new based on the first detection output of the detection unit corresponding to the ON state of the contact.

8. The image forming apparatus as claimed in claim 7, wherein the contact is provided at the main casing.

* * * * *